US010475411B2

(12) United States Patent
Kang et al.

(10) Patent No.: US 10,475,411 B2
(45) Date of Patent: Nov. 12, 2019

(54) DISPLAY APPARATUS HAVING INCREASED SIDE-VISIBILITY IN A HIGH GRAYSCALE RANGE AND A METHOD OF DRIVING THE SAME

(71) Applicant: SAMSUNG DISPLAY CO., LTD., Yongin-si, Gyeonggi-do (KR)

(72) Inventors: Bong-Gyun Kang, Suwon-si (KR); Nam-Gon Choi, Yongin-si (KR); Dong Hwa Shin, Yongin-si (KR); Gi Geun Kim, Seoul (KR); Jae-Sung Bae, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 420 days.

(21) Appl. No.: 15/072,905

(22) Filed: Mar. 17, 2016

(65) Prior Publication Data

US 2017/0084242 A1 Mar. 23, 2017

(30) Foreign Application Priority Data

Sep. 23, 2015 (KR) ..... 10-2015-0134659

(51) Int. Cl.
*G09G 5/10* (2006.01)
*G09G 3/36* (2006.01)

(52) U.S. Cl.
CPC ..... *G09G 3/3685* (2013.01); *G09G 2310/027* (2013.01); *G09G 2320/0673* (2013.01)

(58) Field of Classification Search
CPC ..... G09G 3/3685; G09G 2310/027; G09G 2320/0673
USPC ..... 345/690
See application file for complete search history.

(56) References Cited

U.S. PATENT DOCUMENTS 6,297,788 B1 * 10/2001 Shigeta ..... G09G 3/2018 345/589
2007/0091021 A1 * 4/2007 Uota ..... G09G 3/2007 345/63
2008/0129673 A1 * 6/2008 Kim ..... G09G 3/3406 345/89
2008/0218463 A1 * 9/2008 Lee ..... G09G 3/3696 345/89
2013/0076803 A1 * 3/2013 Lee ..... G09G 3/3233 345/690

(Continued)

FOREIGN PATENT DOCUMENTS

KR 1020100007077 1/2010

*Primary Examiner* — Jonathan M Blancha
(74) *Attorney, Agent, or Firm* — F. Chau & Associates, LLC

(57) ABSTRACT

A display apparatus includes: a display panel including a data line, a gate line crossing the data line, and a sub pixel connected to the data line and the gate line; a gamma data generator configured to output normal gamma data of a normal gamma curve corresponding to image data when a grayscale of the image data is inside a first grayscale range, and to output high gamma data of a high gamma curve or low gamma data of a low gamma curve based on a spatio-temporal pattern when the grayscale of the image data is outside the first grayscale range; and a data driver configured to convert the gamma data outputted from the gamma data generator to a data voltage and to output the data voltage to the data line.

10 Claims, 12 Drawing Sheets

(56) References Cited

U.S. PATENT DOCUMENTS

2013/0201223 A1* 8/2013 Li ..... G09G 3/2022
345/690

* cited by examiner

FIG. 8

< COMBINED GAMMA LUT >

| | DOUT | |
|---|---|---|
| DIN | HIGH GAMMA DATA | LOW GAMMA DATA |
| 0 | 0 | 0 |
| 1 | 20 | 0 |
| 2 | 30 | 0 |
| 3 | 40 | 0 |
| . | . | . |
| . | . | . |
| . | . | . |
| 180 | 255 | 15 |
| | NORMAL GAMMA DATA | |
| 181 | 187 | |
| 182 | 188 | |
| . | . | |
| . | . | |
| . | . | |
| 255 | 255 | |

DISPLAY APPARATUS HAVING INCREASED SIDE-VISIBILITY IN A HIGH GRAYSCALE RANGE AND A METHOD OF DRIVING THE SAME

CROSS-REFERENCE TO RELATED APPLICATION

This application claims priority under 35 U.S.C. § 119 to Korean Patent Application No. 10-2015-0134659 filed on Sep. 23, 2015, the disclosure of which is incorporated by reference herein in its entirety.

TECHNICAL FIELD

Exemplary embodiments of the inventive concept relate to a display apparatus and a method of driving the display apparatus.

DESCRIPTION OF THE RELATED ART

A liquid crystal display (LCD) panel may include a thin film transistor (TFT) substrate, an opposing substrate and a liquid crystal layer disposed between the two substrates. The TFT substrate may include a plurality of gate lines, a plurality of data lines crossing the gate lines, a plurality of TFTs connected to the gate lines and the data lines, and a plurality of pixel electrodes connected to the TFTs. A TFT may include a gate electrode extended from a gate line, a source electrode extended to a data line, and a drain electrode spaced apart from the source electrode.

The LCD panel may not emit light by itself. In other words, it is not self-emissive. The LCD panel may receive light from the back of the LCD panel (via a backlight) or from the front of the LCD panel (via a frontlight). The LCD panel may have limited side-visibility. A multi-domain LCD panel may have better side visibility.

SUMMARY

According to an exemplary embodiment of the inventive concept, there is provided a display apparatus. The display apparatus includes a display panel comprising a data line, a gate line crossing the data line, and a sub pixel connected to the data line and the gate line, a gamma data generator configured to output normal gamma data of a normal gamma curve corresponding to image data when a grayscale of the image data is inside a first grayscale range, and to output high gamma data of a high gamma curve or low gamma data of a low gamma curve based on a spatio-temporal pattern when the grayscale of the image data is outside the first grayscale range, and a data driver configured to convert the gamma data outputted from the gamma data generator to a data voltage and to output the data voltage to the data line.

In an exemplary embodiment of the inventive concept, the first grayscale range may correspond to a high grayscale range including high grayscales.

In an exemplary embodiment of the inventive concept, the first grayscale range may correspond to a middle grayscale range including middle grayscales.

In an exemplary embodiment of the inventive concept, the gamma data generator may include a high gamma look-up table (LUT) configured to store high gamma data grayscales based on the high gamma curve, a low gamma LUT configured to store low gamma data grayscales based on the low gamma curve, and a normal gamma LUT configured to store normal gamma data grayscales based on the normal gamma curve.

In an exemplary embodiment of the inventive concept, the gamma data generator may include a combined gamma LUT, wherein the combined gamma LUT may include the normal gamma data of the normal gamma curve corresponding to the first grayscale range, and the high gamma data of the high gamma curve and the low gamma data of the low gamma curve corresponding to a second grayscale range outside the first grayscale range.

In an exemplary embodiment of the inventive concept, the combined gamma LUT may include high gamma data of a modified high gamma curve which connects the high gamma curve and the normal gamma curve in a third range between the first grayscale range and the second range, and low gamma data of a modified low gamma curve which connects the low gamma curve and the normal gamma curve in the third range.

According to an exemplary embodiment of the inventive concept, there is provided a display apparatus. The display apparatus includes a display panel comprising a data line, a gate line crossing the data line and a sub pixel connected to the data line and the gate line, an image analyzer configured to analyze image data and to determine whether the image data corresponds to a static image or a moving image, a gamma look-up table (LUT) generator configured to generate a first gamma LUT which has a first difference between high gamma data and low gamma data in a first grayscale range when the image data corresponds to the static image, and to generate a second gamma LUT which has a second difference between the high gamma data and the low gamma data in the first grayscale range when the image data corresponds to the moving image, the second difference being different from the first difference, a gamma controller configured to output the high gamma data or the low gamma data using the first or second gamma LUT generated from the gamma LUT generator, and a data driver configured to convert the gamma data output from the gamma controller to a data voltage and to output the data voltage to the data line.

In an exemplary embodiment of the inventive concept, when the image data corresponds to the static image, the gamma LUT generator may be configured to generate the first gamma LUT which has the first difference between the high gamma data and the low gamma data in a second grayscale range.

In an exemplary embodiment of the inventive concept, when the image data corresponds to the moving image, the gamma LUT generator may be configured to generate the second gamma LUT which has the second difference between the high gamma data and the low gamma data in the second grayscale range, the second difference being more than the first difference.

In an exemplary embodiment of the inventive concept, the gamma data output from the gamma controller may correspond to the sub pixel.

According to an exemplary embodiment of the inventive concept, there is provided a method of driving a display apparatus. The method includes outputting normal gamma data of a normal gamma curve corresponding to image data when a grayscale of the image data is inside a first grayscale range, the image data corresponding to a sub pixel connected to a data line and a gate line, outputting high gamma data of a high gamma curve or low gamma data of a low gamma curve based on a spatio-temporal pattern when the grayscale of the image data is outside the first grayscale range, and converting the outputted gamma data to a data voltage and outputting the data voltage to the data line.

In an exemplary embodiment of the inventive concept, the first grayscale range may correspond to a high grayscale range including high grayscales.

In an exemplary embodiment of the inventive concept, the first grayscale range may correspond to a middle grayscale range including middle grayscales.

In an exemplary embodiment of the inventive concept, the high gamma data may be outputted using a high gamma look-up table (LUT) configured to store high gamma data grayscales based on the high gamma curve, the low gamma data may be outputted using a low gamma LUT configured to store low gamma data grayscales based on the low gamma curve, and the normal gamma data may be outputted using a normal gamma LUT configured to store normal gamma data grayscales based on the normal gamma curve.

In an exemplary embodiment of the inventive concept, the normal, high or low gamma data may be outputted using a combined gamma LUT comprising the normal gamma data of the normal gamma curve in the first grayscale range, and the high gamma data of the high gamma curve and the low gamma data of the low gamma curve in a second grayscale range outside the first grayscale range.

In an exemplary embodiment of the inventive concept, the combined gamma LUT may include high gamma data of a modified high gamma curve which connects the high gamma curve and the normal gamma curve in a third range between the first grayscale range and the second grayscale range, and low gamma data of a modified low gamma curve which connects the low gamma curve and the normal gamma curve in the third range.

According to an exemplary embodiment of the inventive concept, there is provided a method of driving a display apparatus. The method includes analyzing image data to determine whether the image data corresponds to a static image or a moving image, generating a first gamma LUT which has a first difference between high gamma data and low gamma data in a first grayscale range when the image data corresponds to the static image, generating a second gamma LUT which has a second difference between the high gamma data and the low gamma data in the first grayscale range when the image data corresponds to the moving image, the second difference being different from the first difference, outputting the high gamma data or the low gamma data using a gamma LUT generated based on a spatio-temporal pattern, and converting the outputted high or low gamma data to a data voltage and outputting the data voltage to the data line.

In an exemplary embodiment of the inventive concept, when the image data corresponds to the static image, the first gamma LUT which has the first difference between the high gamma data and the low gamma data in a second grayscale range may be generated.

In an exemplary embodiment of the inventive concept, when the image data corresponds to the moving image, the second gamma LUT which has the second difference between the high gamma data and the low gamma data in the second grayscale range may be generated, the second difference being more than the first difference.

In an exemplary embodiment of the inventive concept, the outputted high or low gamma data may correspond to the sub pixel connected to a data line and a gate line.

BRIEF DESCRIPTION OF THE DRAWINGS

The above and other features of the inventive concept will become more apparent by describing in detail exemplary embodiments thereof with reference to the accompanying drawings, in which:

FIG. 8 is a diagram illustrating a combined gamma LUT based the combined gamma curve of FIG. 7 according to an exemplary embodiment of the inventive concept;

DETAILED DESCRIPTION OF THE EMBODIMENTS

Hereinafter, exemplary embodiments of the inventive concept will be explained in detail with reference to the accompanying drawings.

Figure 1:
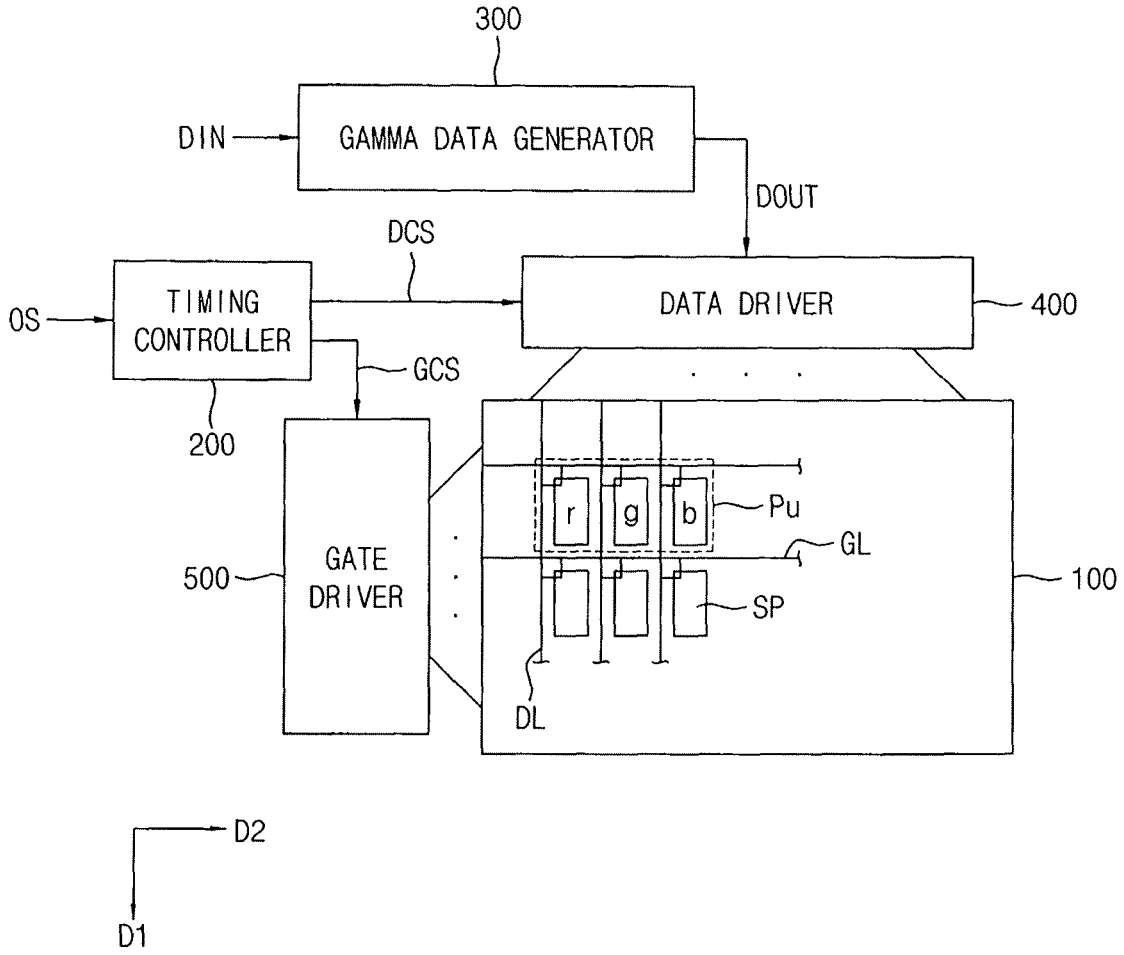
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, the display apparatus may include a display panel 100, a timing controller 200, a gamma data generator 300, a data driver 400 and a gate driver 500.

The display panel 100 may include a plurality of data lines DL, a plurality of gate lines GL and a plurality of pixel units PU. The data lines DL extend in a first direction D1 and are arranged in a second direction D2 crossing the first direction D1. The gate lines GL extend in the second direction D2 and are arranged in the first direction D1. The pixel units PU are arranged in a matrix or array which includes a plurality of pixel rows and a plurality of pixel columns. Each of the pixel units PU may include a plurality of sub pixels SP. For example, the pixel unit PU includes a red sub pixel r, a green sub pixel g and a blue sub pixel b.

The timing controller 200 controls an operation of the display apparatus. The timing controller 200 is configured to receive an original synch signal OS, and to generate a plurality of control signals for driving the display panel 100 based on the original synch signal OS. The control signals may include a data control signal DCS for controlling the data driver 400 and a gate control signal GCS for controlling the gate driver 500.

The data control signal DCS may include a horizontal synch signal, a vertical synch signal, a data enable signal, a polarity control signal and so on. The gate control signal GCS may include a vertical start signal, a gate clock signal, an output enable signal and so on.

The gamma data generator 300 is configured to generate gamma data DOUT corresponding to image data DIN of a sub pixel using high and low gamma curves in both the space division method and the time division method during a Time Gamma Mixed (TGM) driving mode. The gamma data generator 300 is also configured to generate gamma data DOUT corresponding to image data DIN of a sub pixel using a normal gamma curve.

Generally, a display apparatus is driven with the TGM driving mode to increase a side-visibility. In this case, a gamma data generator is configured to generate high gamma data or low gamma data corresponding to image data of a sub pixel using high and low gamma curves in both the space division method and the time division method. However, when a grayscale of the image data is in a high grayscale range, a side-visibility in the normal driving mode is better than that of the TGM driving mode.

According to the present exemplary embodiment, when the grayscale of the image data is in the high grayscale range, the gamma data generator 300 is configured to generate gamma data in the normal driving mode, and when the grayscale of the image data is in a grayscale range other than the high grayscale range, the gamma data generator 300 is configured to generate gamma data in the TGM driving mode. Therefore, the side-visibility in the high grayscale range may be increased.

The data driver 400 is configured to convert the gamma data DOUT generated from the gamma data generator 300 to a data voltage and to output the data voltage to the data line DL of the display panel 100.

The gate driver 500 is configured to generate a plurality of gate signals, and to sequentially output the gate signals to the gate lines GL of the display panel 100.

Figure 2:
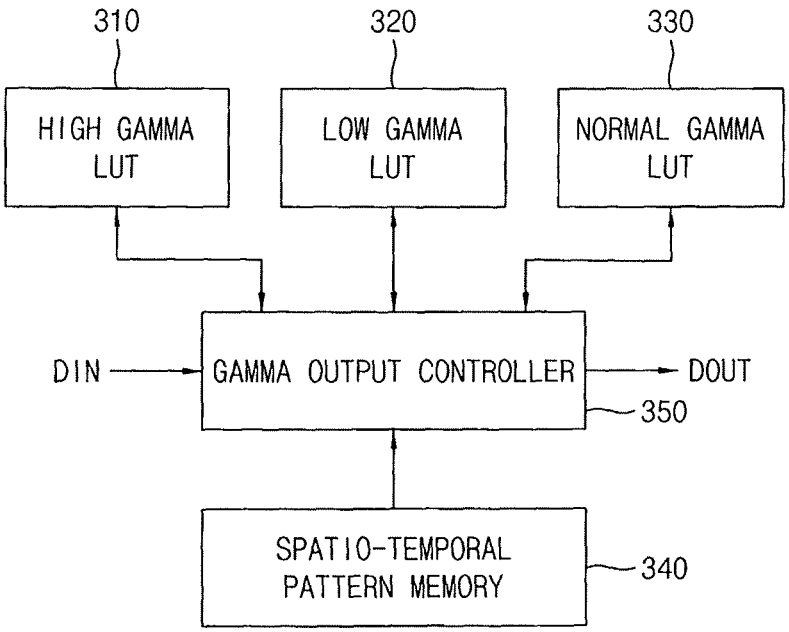
FIG. 2 is a block diagram illustrating a gamma data generator of FIG. 1 according to an exemplary embodiment of the inventive concept.
Figure 3:
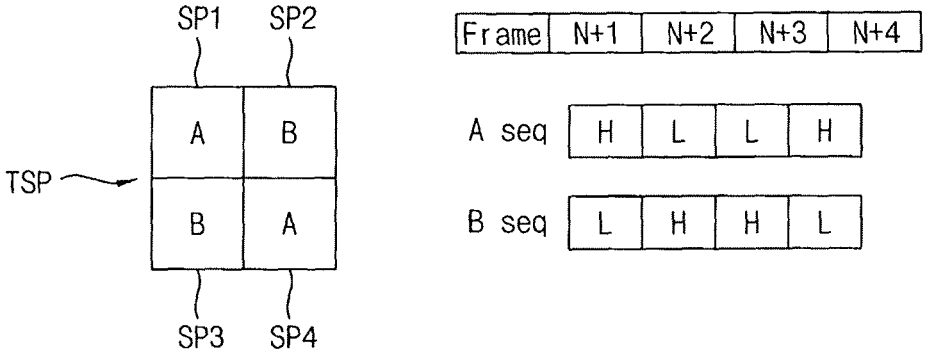
FIG. 3 is a diagram illustrating a spatio-temporal pattern memory of FIG. 2 according to an exemplary embodiment of the inventive concept.
Figure 4:
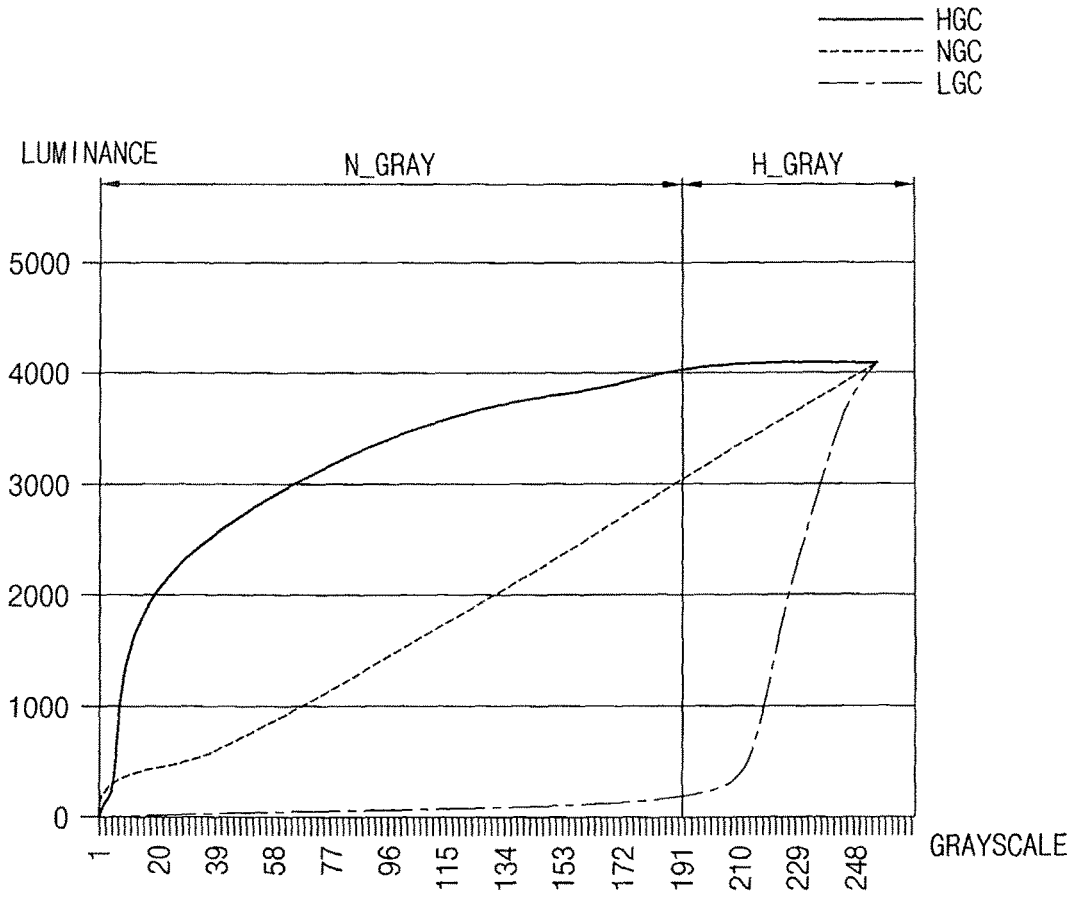
FIG. 4 is a diagram illustrating high, low and normal gamma look-up tables (LUTs) according to an exemplary embodiment of the inventive concept.
Figure 5:
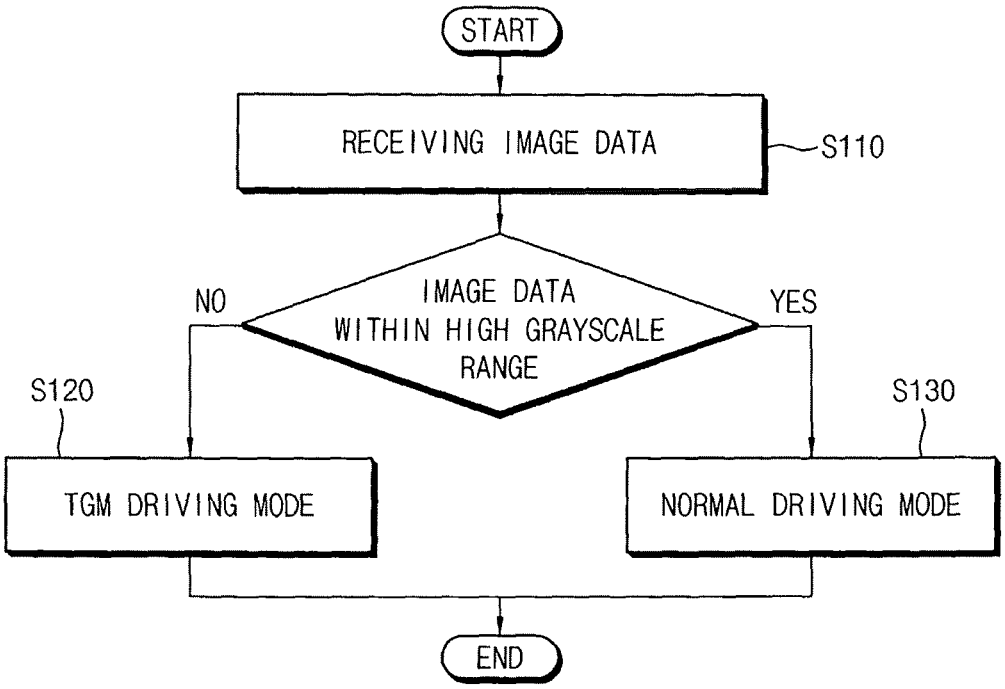
FIG. 5 is a flowchart illustrating a method of driving a display apparatus according to an exemplary embodiment of the inventive concept.

FIG. 2 is a block diagram illustrating a gamma data generator of FIG. 1 according to an exemplary embodiment of the inventive concept. FIG. 3 is a diagram illustrating a spatio-temporal pattern memory of FIG. 2 according to an exemplary embodiment of the inventive concept. FIG. 4 is a diagram illustrating high, low and normal gamma look-up tables (LUTs) according to an exemplary embodiment of the inventive concept. FIG. 5 is a flowchart illustrating a method of driving a display apparatus according to an exemplary embodiment of the inventive concept.

In FIG. 4, the x-axis corresponds to grayscale and the y-axis corresponds to luminance.

Referring to FIGS. 2, 3 and 4, the gamma data generator 300 may include a high gamma look-up table (LUT) 310, a low gamma LUT 320, a normal gamma LUT 330, a spatio-temporal pattern memory 340 and a gamma output controller 350.

The high gamma LUT 310 is configured to store high gamma data corresponding to grayscales based on a high gamma curve HGC as shown in FIG. 4.

The low gamma LUT 320 is configured to store low gamma data corresponding to grayscales based on a low gamma curve LGC as shown in FIG. 4.

The normal gamma LUT 330 is configured to store normal gamma data corresponding to grayscales based on a normal gamma curve NGC as shown in FIG. 4

The spatio-temporal pattern memory 340 is configured to store a spatio-temporal pattern for the TGM driving mode. Referring to FIG. 3, the spatio-temporal pattern TSP includes a spatial pattern which has an array of high gamma data H of the high gamma curve HGC and low gamma data L of the low gamma curve LGC corresponding to sub pixels SP1, SP2, SP3 and SP4 arranged in a (2×2) matrix or array, and a temporal pattern which has a sequence of the high gamma data H and the low gamma data L respectively corresponding to the sub pixels SP1, SP2, SP3 and SP4 during a plurality of frames, for example, 4 frames. The temporal pattern includes a first sequence A and second sequence B.

For example, referring to the spatio-temporal pattern TSP, a first sub pixel SP1 and a fourth sub pixel SP4 adjacent to the first sub pixel SP1 in a first diagonal direction have a first sequence A, and a second sub pixel SP2 and a third sub pixel SP3 adjacent to the second sub pixel SP2 in a second diagonal direction have a second sequence B.

Each of the first and second sequences A and B has a preset sequence with respect to the high gamma data H of the high gamma curve HGC and the low gamma data L of the low gamma curve LGC. For example, the gamma data DOUT of a sub pixel having the first sequence A has a sequence as "H→L→L→H" during 4 frames N+1, N+2, N+3 and N+4 with respect to the high gamma data H of the high gamma curve HGC and the low gamma data L of the low gamma curve LGC. The gamma data DOUT of a sub pixel having the second sequence B has a sequence as "L→H→H→L" during 4 frames N+1, N+2, N+3 and N+4 with respect to the high gamma data H of the high gamma curve HGC and the low gamma data L of the low gamma curve LGC. The spatio-temporal pattern may be variously preset according to physical characteristics and driving characteristics of the display panel 100.

The gamma output controller 350 is configured to output the normal gamma data DOUT using the normal gamma LUT 330 when the grayscale of the image data DIN is in a high grayscale range H_GRAY. The gamma output controller 350 is configured to output the high gamma data or the low gamma data DOUT using the high gamma LUT 310 and the low gamma LUT 320 based on the spatio-temporal pattern when the grayscale of the image data DIN is in a grayscale range N_GRAY lower than the high grayscale range H_GRAY.

Referring to FIG. 5, for example, the high grayscale range may be a range from 180-grayscale to 255-grayscale.

The gamma output controller 350 is configured to receive image data DIN of 100-grayscale during an (N+1)-th frame (Step S110). The gamma output controller 350 is configured to generate gamma data DOUT corresponding to the image data DIN of 100-grayscale in the TGM driving mode because the image data DIN of 100-grayscale is outside the high grayscale range (Step S120).

When the image data of 100 grayscale corresponds to a first sub pixel SP1 of the spatio-temporal pattern TSP in FIG. 3, the gamma output controller 350 is configured to output high gamma data H using the high gamma LUT 310 based on the first sequence A during the (N+1)-th frame.

Then, when image data of 110-grayscale which is outside the high grayscale range, is received during an (N+2)-th frame, the gamma output controller 350 is configured to output low gamma data L using the low gamma LUT 320 based on the first sequence A during the (N+2)-th frame (Step S120). When image data of 200-grayscale which is inside the high grayscale range, is received during the (N+2)-th frame, the gamma output controller 350 is configured to output normal gamma data using the normal gamma LUT 330 in the normal driving mode during the (N+2)-th frame (Step S130).

Then, when image data of 150-grayscale which is outside the high grayscale range, is received during an (N+3)-th frame, the gamma output controller 350 is configured to output low gamma data L using the low gamma LUT 320 based on the first sequence A during the (N+3)-th frame (Step S120). When image data of 190-grayscale which is inside the high grayscale range, is received during the (N+3)-th frame, the gamma output controller 350 is configured to output normal gamma data using the normal gamma LUT 330 in the normal driving mode during the (N+3)-th frame (Step S130).

Then, when image data of 100-grayscale which is outside the high grayscale range, is received during an (N+4)-th frame, the gamma output controller 350 is configured to output high gamma data H using high gamma LUT 310 based on the first sequence A during the (N+4)-th frame (Step S120). When image data of 240-grayscale which is inside the high grayscale range, is received during the (N+4)-th frame, the gamma output controller 350 is configured to output normal gamma data using the normal gamma LUT 330 in normal driving mode during the (N+4)-th frame (Step S130).

According to the present exemplary embodiment, when the grayscale of the image data is in the high grayscale range, the gamma data of the image data is generated in the normal driving mode and when the grayscale of the image data is not in the high grayscale range, the gamma data of the image data is generated in the TGM driving mode. As the described above, the TGM driving mode and the normal driving mode are selectively operated according to the grayscale of the image data, and thus, the side-visibility of the high grayscale range may be increased.

Figure 6:
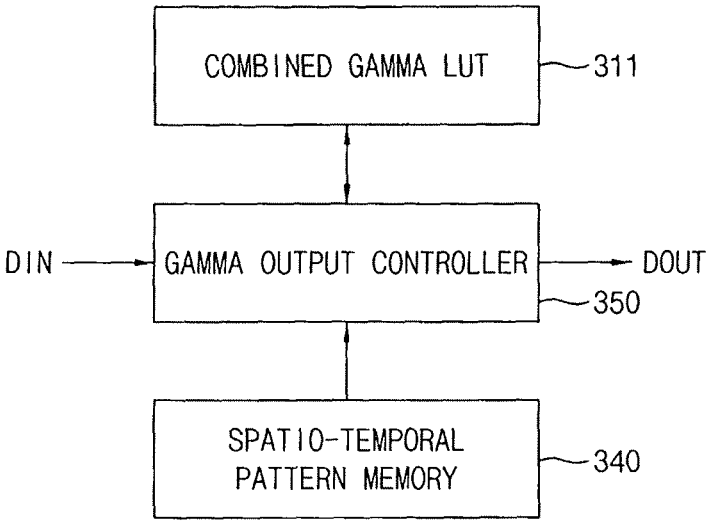
FIG. 6 is a block diagram illustrating a gamma data generator according to an exemplary embodiment of the inventive concept.
Figure 7:
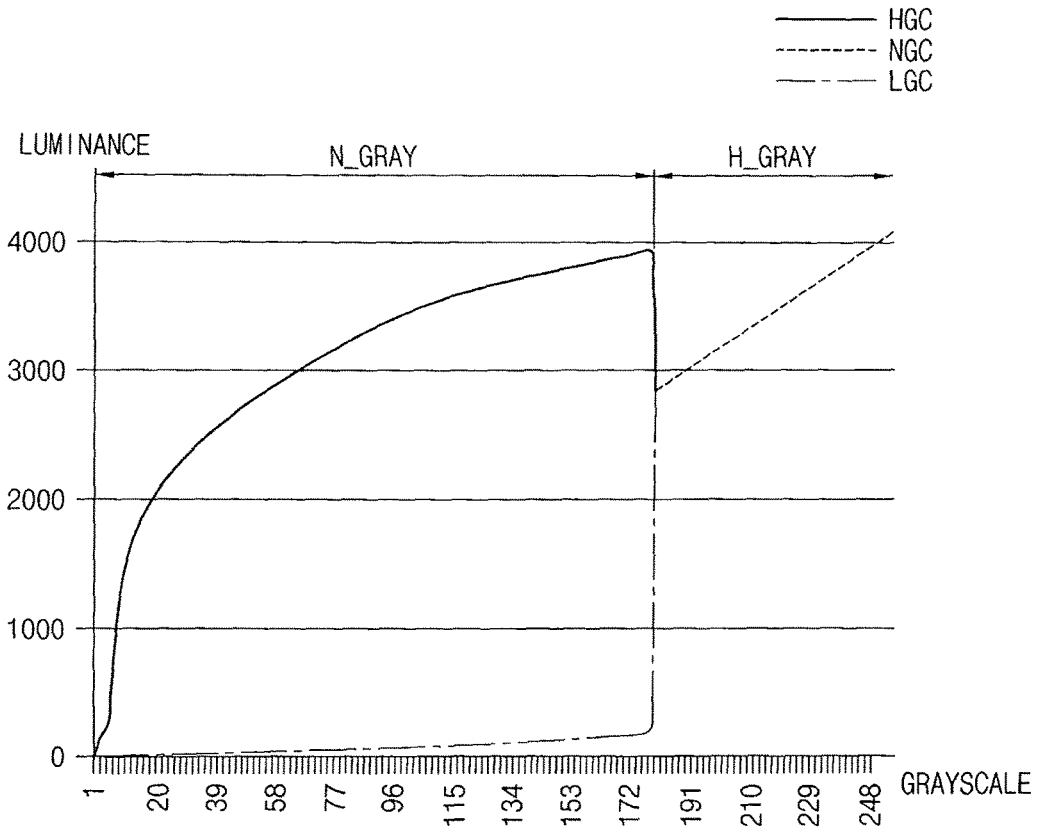
FIG. 7 is a combined gamma curve according to an exemplary embodiment of the inventive concept.

FIG. 6 is a block diagram illustrating a gamma data generator according to an exemplary embodiment of the inventive concept. FIG. 7 is a combined gamma curve according to an exemplary embodiment of the inventive concept. FIG. 8 is a diagram illustrating a combined gamma LUT based the combined gamma curve of FIG. 7 according to an exemplary embodiment of the inventive concept.

Referring to FIGS. 6 and 7, the gamma data generator may include a combined gamma LUT 311, a spatio-temporal pattern memory 340 and a gamma output controller 350.

The combined gamma LUT 311 is configured to store high, low and normal gamma data based on a combined gamma curve which includes a high gamma curve HGC, a low gamma curve LGC and a normal gamma curve NGC corresponding to grayscale ranges.

The combined gamma LUT 311 is configured to store normal gamma data based on the normal gamma curve NGC in a high grayscale range H_GRAY, and high gamma data based on the high gamma curve HGC and low gamma data based on the low gamma curve LGC in a grayscale range N_GRAY other than the high grayscale range H_GRAY.

The spatio-temporal pattern memory 340 is configured to store a spatio-temporal pattern for the TGM driving mode. Referring to FIG. 3, the spatio-temporal pattern TSP includes a spatial pattern which has an array of high gamma data H of the high gamma curve HGC and low gamma data L of the low gamma curve LGC corresponding to sub pixels SP1, SP2, SP3 and SP4 arranged in a (2×2) matrix or array, and a temporal pattern which has a sequence of the high gamma data H and the low gamma data L respectively corresponding to the sub pixels SP1, SP2, SP3 and SP4 during a plurality of frames, for example, 4 frames. The temporal pattern includes a first sequence A and second sequence B.

The gamma output controller 350 is configured to output the normal gamma data DOUT using the combined gamma LUT 311 when the grayscale of the image data DIN is in a high grayscale range H_GRAY. The gamma output controller 350 is configured to output the high and low gamma data DOUT using the combined gamma LUT 311 based on the spatio-temporal pattern when the grayscale of the image data DIN is in the grayscale range N_GRAY.

Referring to FIG. 8, for example, the gamma output controller 350 is configured to output the normal gamma data DOUT using the combined gamma LUT 311 when the grayscale of the image data DIN is in the high grayscale range H_GRAY which is from 181-grayscale to 255-grayscale.

As further shown in FIG. 8, the gamma output controller 350 is configured to output the high gamma data or the low gamma data DOUT using the combined gamma LUT 311 based on the spatio-temporal pattern in the spatio-temporal pattern memory 340 when the grayscale of the image data DIN is in the grayscale range N_GRAY which is from 0-grayscale to 180 grayscale.

According to the present exemplary embodiment, a size of a memory storing the combined gamma LUT 311 may be decreased.

According to the present exemplary embodiment, when the grayscale of the image data is in the high grayscale range, the gamma data of the image data is generated in the normal driving mode and when the grayscale of the image data is not in the high grayscale range, the gamma data of the image data is generated in the TGM driving mode. As the described above, the TGM driving mode and the normal driving mode are selectively operated according to the grayscale of the image data, and thus, the side-visibility of the high grayscale range may be increased.

Figure 9:
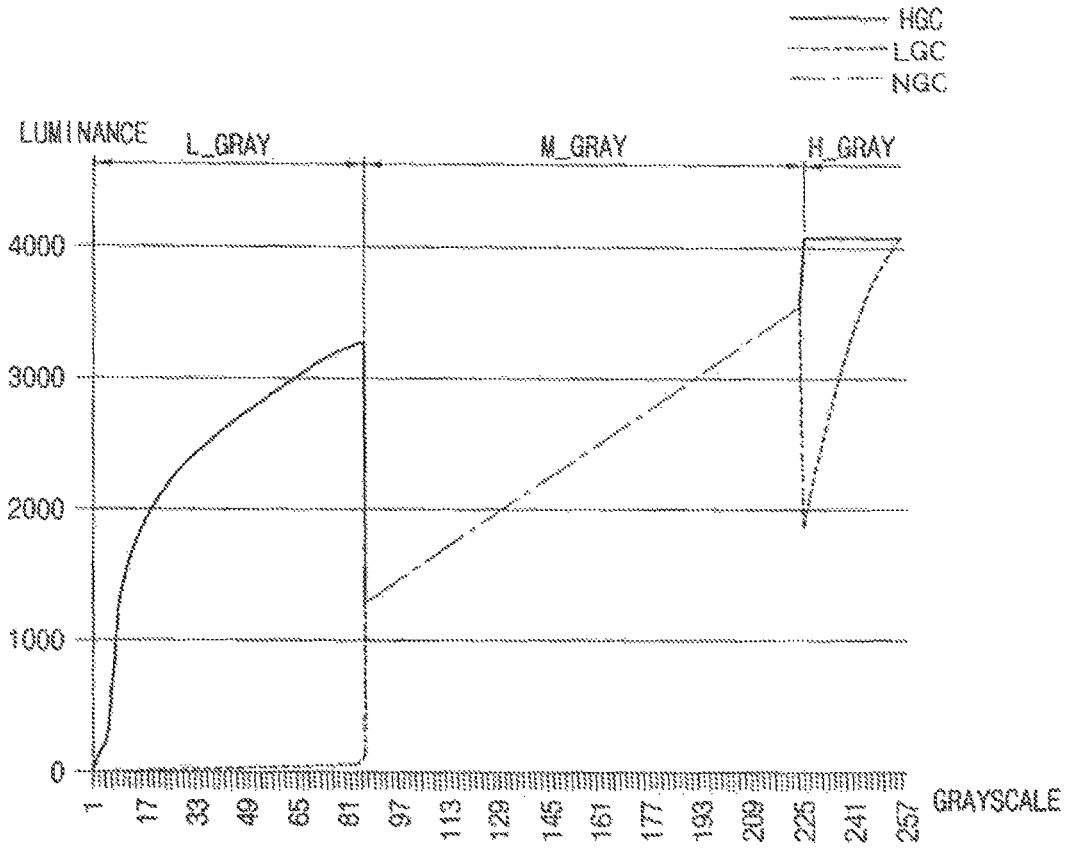
FIG. 9 is a diagram illustrating a combined gamma curve according to an exemplary embodiment of the inventive concept.

FIG. 9 is a diagram illustrating a combined gamma curve according to an exemplary embodiment of the inventive concept.

Referring to FIG. 9, the combined gamma curve may be divided into a low grayscale range L_GRAY, a middle grayscale range M_GRAY and a high grayscale range H_GRAY.

A combined gamma LUT according to the combined gamma curve of FIG. 9, may include high gamma data of a high gamma curve HGC and low gamma data of a low gamma curve LGC in the low grayscale range L_GRAY, normal gamma data of a normal gamma curve NGC in the middle grayscale range M_GRAY, and high gamma data of a high gamma curve HGC and low gamma data of a low gamma curve LGC in the high grayscale range H_GRAY.

According to the present exemplary embodiment, when a grayscale of the image data is in the low grayscale range L_GRAY which is from 0-grayscale to 82-grayscale, a gamma output controller is configured to output high gamma data or low gamma data corresponding to the grayscale of the image data using the combined gamma LUT based on the spatio-temporal pattern in the TGM driving mode. A method of generating the gamma data in the TGM driving mode is substantially the same as that described in reference to FIG. 5.

When a grayscale of the image data is in the middle grayscale range M_GRAY which is from 83-grayscale to 220-grayscale, the gamma output controller is configured to output normal gamma data corresponding to the grayscale of the image data using the combined gamma LUT in the normal driving mode.

When a grayscale of the image data is in the high grayscale range H_GRAY which is from 221-grayscale to 255-grayscale, the gamma output controller is configured to output high gamma data or low gamma data corresponding to the grayscale of the image data using the combined gamma LUT based on the spatio-temporal pattern in the TGM driving mode. A method of generating the gamma data in the TGM driving mode is substantially the same as that described in reference to FIG. 5.

Generally, middle grayscales can have a big impact on a moving artifact. According to the present exemplary embodiment, when the grayscale of the image data is in the middle grayscale range, the gamma data of the image data is generated in the normal driving mode, and when the grayscale of the image data is in the low and high grayscale range, the gamma data of the image data is generated in the TGM driving mode. Therefore, quality of the moving artifact may be increased in the middle grayscale range.

Figure 10:
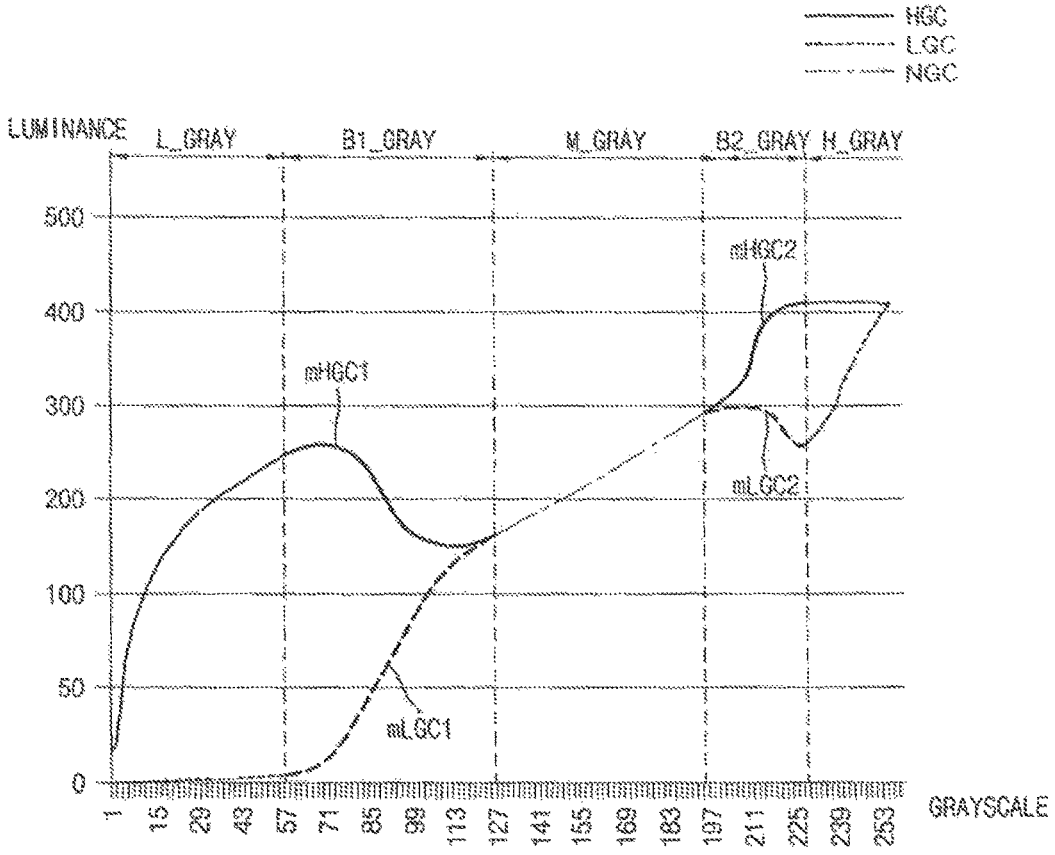
FIG. 10 is a diagram illustrating a combined gamma curve according to an exemplary embodiment of the inventive concept.

FIG. 10 is a diagram illustrating a combined gamma curve according to an exemplary embodiment of the inventive concept.

Referring to FIG. 10, the combined gamma curve may be divided into a low grayscale range L_GRAY, a first boundary range B1_GRAY, a middle grayscale range M_GRAY, a second boundary range B2_GRAY and a high grayscale range H_GRAY.

A combined gamma LUT according to the combined gamma curve of FIG. 10, may include high gamma data corresponding to a high gamma curve HGC and low gamma data corresponding to a low gamma curve LGC in the low grayscale range L_GRAY, normal gamma data corresponding to a normal gamma curve NGC in the middle grayscale range M_GRAY and high gamma data corresponding to the high gamma curve HGC and low gamma data corresponding to the low gamma curve LGC in the high grayscale range H_GRAY.

In addition, the combined gamma LUT according to the combined gamma curve of FIG. 10 may further include high gamma data corresponding to a first modified high gamma curve mHGC1 and low gamma data corresponding to a first modified low gamma curve mLGC1 in the first boundary range B1_GRAY. The first modified high gamma curve mHGC1 gradually connects the high gamma curve HGC in the low grayscale range L_GRAY and the normal gamma curve NGC in the middle grayscale range M_GRAY. The first modified low gamma curve mLGC1 gradually connects the low gamma curve LGC in the low grayscale range L_GRAY and the normal gamma curve NGC in the middle grayscale range M_GRAY.

In addition, the combined gamma LUT according to the combined gamma curve of FIG. 10 may further include high gamma data corresponding to a second modified high gamma curve mHGC2 and low gamma data corresponding to a second modified low gamma curve mLGC2 in the second boundary range B2_GRAY. The second modified high gamma curve mHGC2 gradually connects the normal gamma curve NGC in the middle grayscale range M_GRAY and the high gamma curve HGC in the high grayscale range H_GRAY. The second modified low gamma curve mLGC2 gradually connects the normal gamma curve NGC in the middle grayscale range M_GRAY and the low gamma curve LGC in the high grayscale range H_GRAY.

According to the combined gamma curve of FIG. 9, display defects may be observed by a gamma inflection point in a boundary range between the low grayscale range L_GRAY and the middle grayscale range M_GRAY or between the middle grayscale range M_GRAY and the high grayscale range H_GRAY. According to the combined gamma curve of FIG. 10, the display defects may be eliminated and/or decreased by the modified gamma curves in the boundary range between the low grayscale range L_GRAY and the middle grayscale range M_GRAY or between the middle grayscale range M_GRAY and the high grayscale range H_GRAY.

Figure 11:
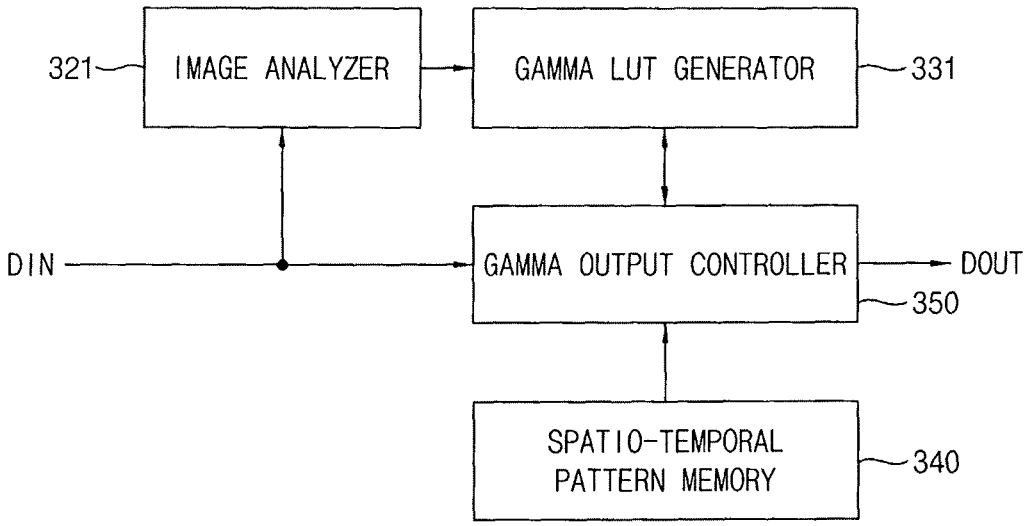
FIG. 11 is a block diagram illustrating a gamma data generator according to an exemplary embodiment of the inventive concept.
Figure 12:
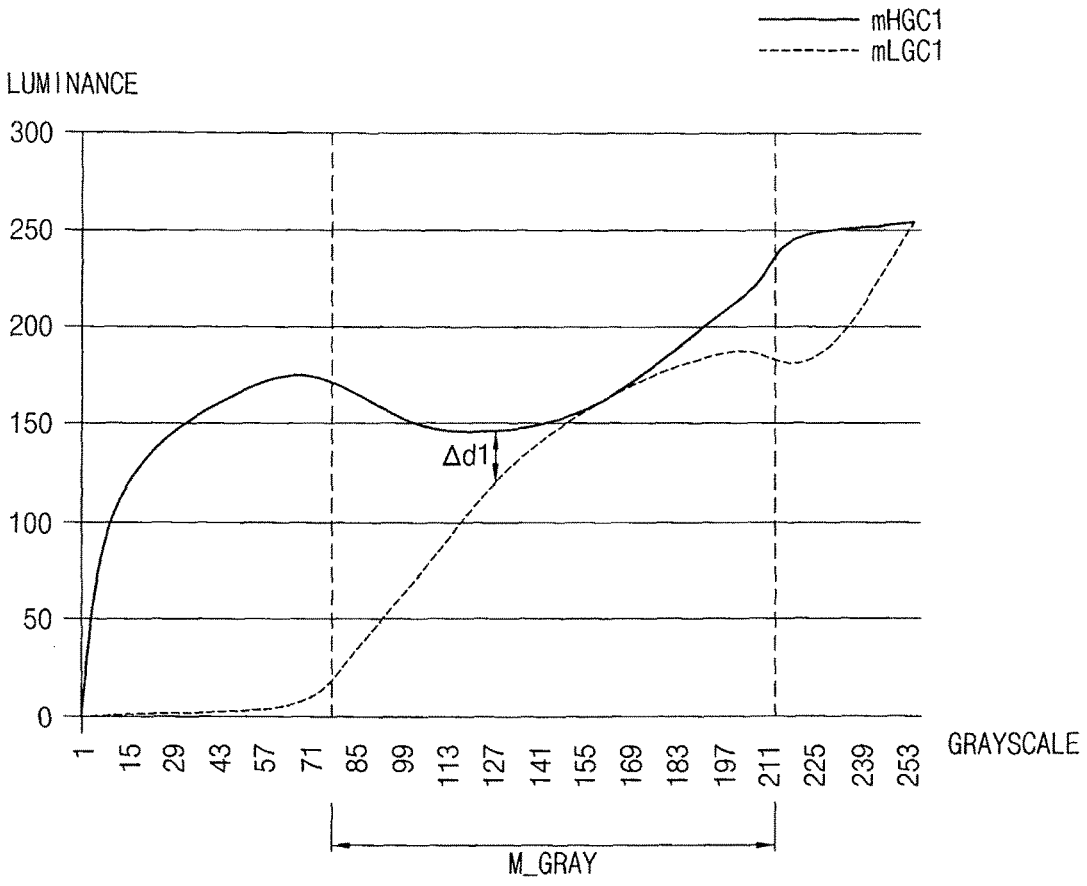
FIG. 12 is a diagram illustrating a gamma LUT generated from a gamma LUT generator of FIG. 11 according to an exemplary embodiment of the inventive concept.
Figure 13:
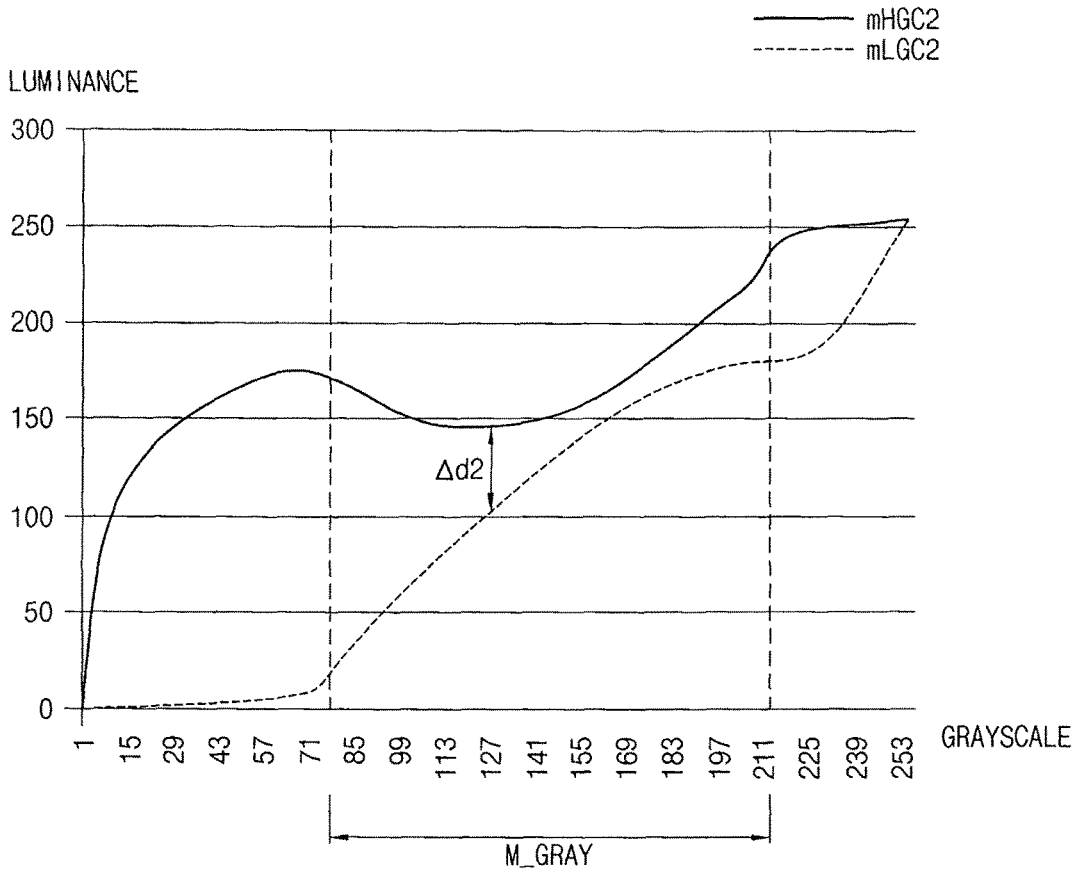
FIG. 13 is a diagram illustrating a gamma LUT generated from a gamma LUT generator of FIG. 11 according to an exemplary embodiment of the inventive concept.

FIG. 11 is a block diagram illustrating a gamma data generator according to an exemplary embodiment of the inventive concept. FIG. 12 is a diagram illustrating a gamma LUT generated from a gamma LUT generator of FIG. 11 according to an exemplary embodiment of the inventive concept. FIG. 13 is a diagram illustrating a gamma LUT generated from a gamma LUT generator of FIG. 11 according to an exemplary embodiment of the inventive concept.

Referring to FIGS. 11, 12 and 13, the gamma data generator may include an image analyzer 321, a gamma LUT generator 331, a spatio-temporal pattern memory 340 and a gamma output controller 350.

The image analyzer 321 is configured to analyze image data DIN and to determine whether the image data DIN corresponds to a static image or a moving image.

Since a static image has few moving artifacts, when the image data is the static image, the side-visibility is increased. Since a moving artifact has a big influence in display quality of a moving image, when the image data is a moving image, the moving artifact is reduced or eliminated.

The gamma LUT generator 331 is configured to generate a combined gamma LUT based on an image type of the image data DIN analyzed by the image analyzer 321.

For example, when the image data DIN corresponds to the static image, the gamma LUT generator 331 is configured to generate a first combined gamma LUT for increasing the side-visibility. When the image data DIN corresponds to the moving image, the gamma LUT generator 331 is configured to generate a second combined gamma LUT for reducing or eliminating the moving artifact.

In the middle grayscale range, when a difference between the high and low gamma data increases, the increasing of the side-visibility may be more effective and the reduction or elimination of the moving artifact may be less effective. In the middle grayscale range, the difference between the high and low gamma data decreases, and thus, the reduction or elimination of the moving artifact may become more effective, while the increase of the side-visibility may become less effective.

Therefore, when the image data DIN corresponds to the static image, as shown in FIG. 12, the gamma LUT generator 331 is configured to generate a first combined gamma LUT which corresponds to a first modified high gamma curve mHGC1 and a first modified low gamma curve mLGC1 having a first difference Δd1 in the middle grayscale range M_GRAY. The first modified high gamma curve mHGC1 and the first modified low gamma curve mLGC1 are based on a first high gamma curve HGC1 and a first low gamma curve LGC1.

When the image data DIN corresponds to the moving image, as shown in FIG. 13, the gamma LUT generator 331 is configured to generate a second combined gamma LUT which corresponds to a second modified high gamma curve mHGC2 and a second modified low gamma curve mLGC2 having a second difference Δd2 more than the first difference Δd1 in the middle grayscale range M_GRAY. The second modified high gamma curve mHGC2 and the second modified low gamma curve mLGC2 are based on a second high gamma curve HGC2 and a second low gamma curve LGC2.

The spatio-temporal pattern memory 340 is configured to store a spatio-temporal pattern for the TGM driving mode. Referring to FIG. 3, the spatio-temporal pattern TSP includes a spatial pattern which corresponds to sub pixels SP1, SP2, SP3 and SP4 arranged in a (2×2) matrix or array, and a temporal pattern which corresponds to the sub pixels SP1, SP2, SP3 and SP4 during a plurality of frames, for example, 4 frames. The temporal pattern includes a first sequence A and second sequence B. A method of generating the gamma data in the TGM driving mode is substantially the same as that described in reference to FIG. 5.

When the image data DIN corresponds to the static image, the gamma output controller 350 is configured to output high gamma data or low gamma data of the image data DIN using the first combined gamma LUT generated from the gamma LUT generator 331. Thus, the gamma output controller 350 is configured to output the high gamma data or the low gamma data corresponding to the image data DIN using the first combined gamma LUT based on the spatio-temporal pattern in stored the spatio-temporal pattern memory 340 (DOUT).

When the image data DIN corresponds to the moving image, the gamma output controller 350 is configured to output high gamma data or low gamma data of the image data DIN using the second combined gamma LUT generated from the gamma LUT generator 331. Thus, the gamma output controller 350 is configured to output the high gamma data or the low gamma data corresponding to the image data DIN using the second combined gamma LUT based on the spatio-temporal pattern in stored the spatio-temporal pattern memory 340 (DOUT).

According to the present exemplary embodiment, an image type of the image data is determined, and high or low gamma data of the image data is generated using high and low gamma curves having controlled differences between the high gamma data and the low gamma data in the middle grayscale range according to the image type. Thus, a display quality of the static image or the moving image may be increased.

Figure 14:
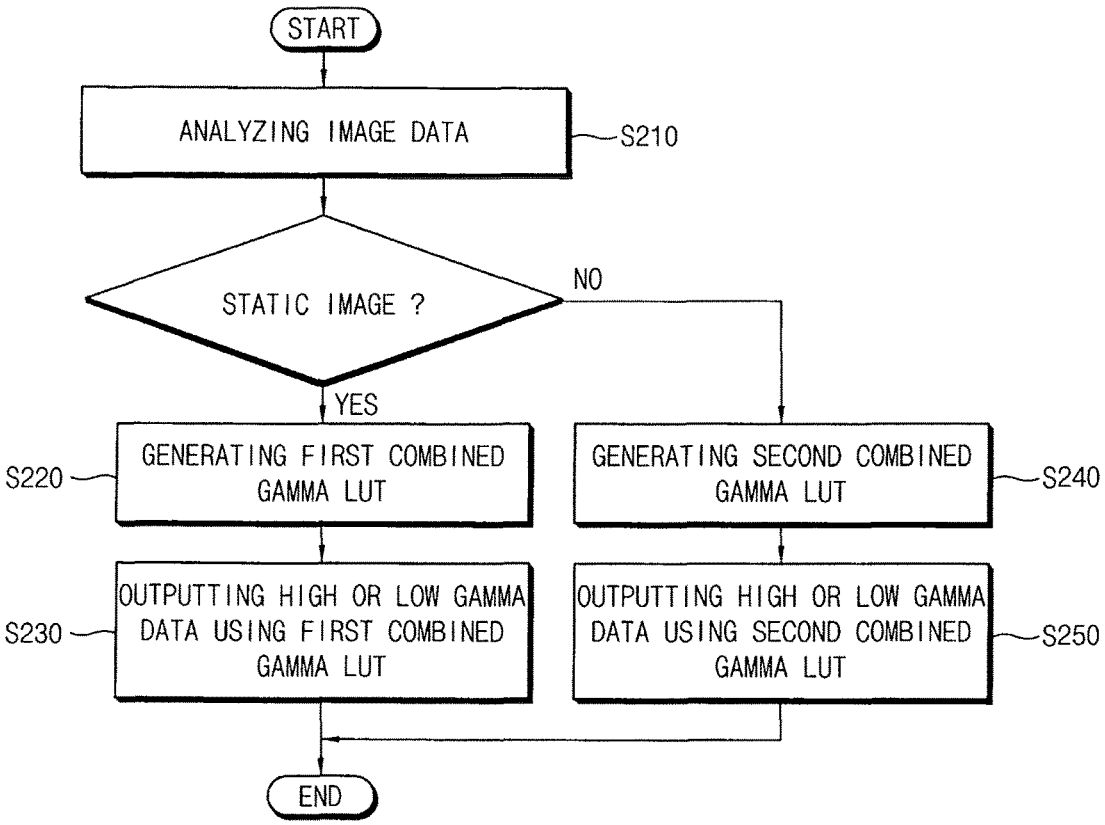
FIG. 14 is a flowchart illustrating a method of driving a display apparatus according to an exemplary embodiment of the inventive concept.

FIG. 14 is a flowchart illustrating a method of driving a display apparatus according to an exemplary embodiment of the inventive concept.

Referring to FIGS. 11 to 14, the image analyzer 321 is configured to analyze image data DIN and to determine whether the image data DIN corresponds to a static image or a moving image (Step S210).

For example, when the image data DIN corresponds to the static image, the gamma LUT generator 331 is configured to generate a first combined gamma LUT for increasing the side-visibility (Step S220). As shown in FIG. 12, the first combined gamma LUT corresponds to a first modified high gamma curve mHGC1 and a first modified low gamma curve mLGC1 having a first difference Δd1 in the middle grayscale range M_GRAY based on a first high gamma curve HGC1 and a first low gamma curve LGC1.

The gamma output controller 350 is configured to output the high gamma data or the low gamma data corresponding to the image data DIN using the first combined gamma LUT based on the spatio-temporal pattern stored in the spatio-temporal pattern memory 340 as shown in FIG. 3 (Step S230). The gamma output controller 350 is configured to output gamma data of the image data DIN in the TGM driving mode (DOUT).

When the image data DIN corresponds to the moving image, the gamma LUT generator 331 is configured to generate a second combined gamma LUT for reducing or eliminating the moving artifact (Step S240). As shown in FIG. 13, the second combined gamma LUT corresponds to a second modified high gamma curve mHGC2 and a second modified low gamma curve mLGC2 having a second difference Δd2 more than the first difference Δd1 in the middle grayscale range M_GRAY based on a second high gamma curve HGC2 and a second low gamma curve LGC2.

The gamma output controller 350 is configured to output the high gamma data or the low gamma data corresponding to the image data DIN using the second combined gamma LUT based on the spatio-temporal pattern stored in the spatio-temporal pattern memory 340 as shown in FIG. 3 (Step S250). The gamma output controller 350 is configured to output gamma data of the image data DIN in the TGM driving mode (DOUT).

According to the present exemplary embodiment, an image type of the image data is determined, and high or low gamma data of the image data is generated using high and low gamma curves having controlled differences between the high gamma data and the low gamma data in the middle grayscale range according to the image type. Thus, a display quality of the static image or the moving image may be increased.

According to an exemplary embodiment of the inventive concept, when the grayscale of the image data is inside the preset grayscale range, the normal gamma data is generated, when the grayscale of the image data is outside the preset grayscale range, the high or low gamma data is generated based on the spatio-temporal pattern, and thus, the side-visibility may be increased and the moving artifact may be eliminated or reduced. In addition, an image type of the image data is determined, and thus, the display quality may be increased according to the image type.

While the inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A display apparatus, comprising:

a display panel comprising a data line, a gate line crossing the data line, and a sub pixel connected to the data line and the gate line;

a gamma data generator configured to output normal gamma data of a normal gamma curve corresponding to image data when a grayscale of the image data is inside a first grayscale range, and to output high gamma data of a high gamma curve and low gamma data of a low gamma curve based on a spatio-temporal pattern when the grayscale of the image data is outside the first grayscale range; and a data driver configured to convert the gamma data outputted from the gamma data generator to a data voltage and to output the data voltage to the data line, wherein the first grayscale range comprises a middle grayscale range including middle grayscales which are between low grayscales and high grayscales, wherein the gamma data generator is configured to output high gamma data of a high gamma curve and low gamma data of a low gamma curve when the grayscale of the image data is inside a high grayscale range, and to output the high gamma data of the high gamma curve and the low gamma data of the low gamma curve when the grayscale of the image data is inside a low grayscale range.

2. The display apparatus of claim 1, wherein the gamma data generator comprises a combined gamma look-up table (LUT), wherein the combined gamma LUT comprises the normal gamma data of the normal gamma curve corresponding to the middle grayscale range, the high gamma data of the high gamma curve corresponding to the high grayscale range and the low gamma data of the low gamma curve corresponding to the low grayscale range.

3. The display apparatus of claim 2, wherein the combined gamma LUT comprises first high gamma data of a first modified high gamma curve which gradually connects the high gamma curve and the normal gamma curve in a first boundary grayscale range between the middle grayscale range and the low grayscale range, first low gamma data of a first modified low gamma curve which gradually connects the low gamma curve and the normal gamma curve in the first boundary grayscale range, second high gamma data of a second modified high gamma curve which gradually connects the high gamma curve and the normal gamma curve in a second boundary grayscale range between the middle grayscale range and the high grayscale range, and second low gamma data of a second modified low gamma curve which gradually connects the low gamma curve and the normal gamma curve in the second boundary grayscale range.

4. The display apparatus of claim 3, wherein the gamma data generator is configured to output the first high gamma data of the first modified high gamma curve and the first low gamma data of the first modified low gamma curve when the grayscale of the image data is inside the first boundary grayscale range, and to output the second high gamma data of the second modified high gamma curve and the second low gamma data of the second modified low gamma curve when the grayscale of the image data is inside the second boundary grayscale range.

5. The display apparatus of claim 1, wherein the gamma data generator comprises:

a high gamma look-up table (LUT) configured to store high gamma data grayscales based on the high gamma curve;

a low gamma LUT configured to store low gamma data grayscales based on the low gamma curve; and a normal gamma LUT configured to store normal gamma data grayscales based on the normal gamma curve.

6. A method of driving a display apparatus, comprising:

outputting normal gamma data of a normal gamma curve corresponding to image data when a grayscale of the image data is inside a first grayscale range, the image data corresponding to a sub pixel connected to a data line and a gate line;

outputting high gamma data of a high gamma curve and low gamma data of a low gamma curve based on a spatio-temporal pattern when the grayscale of the image data is outside the first grayscale range; and converting the outputted gamma data to a data voltage and outputting the data voltage to the data line, wherein the first grayscale range comprises a middle grayscale range including middle grayscales which are between low grayscales and high grayscales, wherein the method further comprises:

outputting the high gamma data of the high gamma curve and the low gamma data of the low gamma curve when the grayscale of the image data is inside a high grayscale range, and outputting the high gamma data of the high gamma curve and the low gamma data of the low gamma curve when the grayscale of the image data is inside a low grayscale range.

7. The method of claim 6, wherein the normal, high and low gamma data are outputted using a combined gamma look-up table (LUT) comprising the normal gamma data of the normal gamma curve corresponding to the middle grayscale range, the high gamma data of the high gamma curve corresponding to the high grayscale range and the low gamma data of the low gamma curve corresponding to the low grayscale range.

8. The method of claim 7, wherein the combined gamma LUT comprises first high gamma data of a first modified high gamma curve which gradually connects the high gamma curve and the normal gamma curve in a first boundary grayscale range between the middle grayscale range and the low grayscale range, first low gamma data of a first modified low gamma curve which gradually connects the low gamma curve and the normal gamma curve in the first boundary grayscale range, second high gamma data of a second modified high gamma curve which gradually connects the high gamma curve and the normal gamma curve in a second boundary grayscale range between the middle grayscale range and the high grayscale range, and second low gamma data of a second modified low gamma curve which gradually connects the low gamma curve and the normal gamma curve in the second boundary grayscale range.

9. The method of claim 8, further comprising:

outputting the first high gamma data of the first modified high gamma curve and the first low gamma data of the first modified low gamma curve when the grayscale of the image data is inside the first boundary grayscale range, and outputting the second high gamma data of the second modified high gamma curve and the second low gamma data of the second modified low gamma curve when the grayscale of the image data is inside the second boundary grayscale range.

10. The method of claim 6, wherein the high gamma data are outputted using a high gamma look-up table (LUT) configured to store high gamma data grayscales based on the high gamma curve, the low gamma data are outputted using a low gamma LUT configured to store low gamma data grayscales based on the low gamma curve, and the normal gamma data are outputted using a normal gamma LUT configured to store normal gamma data grayscales based on the normal gamma curve.

* * * * *